US005480341A

United States Patent [19]

Plakos

[11] Patent Number: 5,480,341

[45] Date of Patent: Jan. 2, 1996

[54] EDUCATIONAL SKELETON TOY WITH OUTER SHELL

[75] Inventor: Andrew E. Plakos, Irvine, Calif.

[73] Assignee: Strottman International, Inc., Irvine, Calif.

[21] Appl. No.: 327,397

[22] Filed: Oct. 21, 1994

[51] Int. Cl.[6] ..... A63H 3/16

[52] U.S. Cl. ..... 446/373; 446/97; 446/268; 434/274

[58] Field of Search ..... 446/98–100, 219, 446/268, 373–375, 85, 97; 434/262, 267, 274, 295

[56] References Cited

U.S. PATENT DOCUMENTS

| | | | |
|---|---|---|---|
| 2,988,823 | 6/1961 | Rosenbloom | 446/375 |
| 3,009,267 | 11/1961 | Bezark | 446/373 |
| 3,132,443 | 5/1964 | Kuhn | 446/112 |
| 3,419,993 | 1/1969 | Rodgers | 446/100 |
| 4,076,155 | 2/1978 | Calvin . | |
| 5,022,886 | 6/1991 | Jenkins | 446/98 |
| 5,061,188 | 10/1991 | McCollum | 434/267 |
| 5,067,924 | 11/1991 | Munter | 446/320 |
| 5,090,910 | 2/1992 | Narlo | 446/100 |
| 5,195,917 | 3/1993 | Russell et al. | 446/97 |
| 5,356,295 | 10/1994 | Grosz | 434/267 |

OTHER PUBLICATIONS

"Plastics That Glow in the Dark," Modern Plastics, Oct. 1948, pp. 88–91.

*Primary Examiner*—Robert A. Hafer
*Assistant Examiner*—Jeffrey D. Carlson
*Attorney, Agent, or Firm*—Richard C. Litman

[57] ABSTRACT

An educational and/or recreational toy including an interior skeletal body surrounded by a shell casing made up of two mating halves readily assembled and taken apart, the halves including mating pin projection and receptacle friction fit securements. The skeletal body may be pigmented with a glow-in-the-dark material. Parts of the skeletal body may protrude through the shell casing. Toys representative of dinosaurs, such as the brontosaur, tyrannosaurus rex, triceratops and stegosaur are specifically disclosed.

13 Claims, 6 Drawing Sheets

EDUCATIONAL SKELETON TOY WITH OUTER SHELL

BACKGROUND OF THE INVENTION

1. Field of the Invention

The present invention relates to educational toys and, more particularly, to a skeleton toy with an outer, two-piece shell.

2. Description of the Prior Art

Educational toys that simulate animals or other figures are known. Unlike prior art educational, animal simulating toys, the present invention provides an educational and recreational toy in the form of an internal, complete skeleton, which may be pigmented with a glow-in-the-dark material, and a two piece, snap together outer shell representing the skin or outer surface of the animal. In one preferred embodiment, the invention takes the forms of dinosaurs.

The relevant prior art discloses dolls or figures with removable, replaceable parts which substantially change the appearance of the underlying figure. The patented art discussed hereinbelow, however, fails to suggest the toy figure of the present invention with an internal body skeleton covered by a shell made of, for example, two snap-together-and-take-apart halves, and which cover substantially all of the underlying skeleton figure but may leave some parts exposed and/or projecting for educational and aesthetic effect and appeal.

U.S. Pat. No. 5,022,886 issued Jun. 11, 1991 to Barbara P. Jenkins teaches a toy doll with rigid clothing accessories added to and removable from the underlying doll figure. A realistic three dimensional figure with an outer shell representing anatomical structure and leaving some internal elements exposed through the shell or casing is not taught or suggested by the Jenkins invention.

A manikin having a rigid attachment so as to convert the appearance of a female torso to a pregnant female torso, the attachment being removable to convert the manikin back to its original form and appearance is seen in U.S. Pat. No. 4,076,155 issued Feb. 28, 1978 to Evangeline M. Calvin. The substantial encasing shell structure which completes but does not alter the intended appearance of the figure, as taught and claimed herein, is not seen in the Calvin patent disclosure.

U.S. Pat. No. 5,067,924 issued Nov. 26, 1991 to Beverly L. Munter teaches a doll for simulating weight gain and/or loss, by providing layers of synthetic material "skin" which are added to or removed from the doll, thus to indicate a human form figure with more or less weight, as desired. The shell cover with an internal skeletal figure as taught herein is not suggested by the teachings of the Munter patent.

U.S. Pat. No. 5,195,917 issued Mar. 23, 1993 to Mary Russell et al. teaches a stress relief doll which may be in the form of a referee or umpire. The user may tear off arms, legs and even the head of the doll, and later replace the same as these members are attached by hook and loop fasteners or the like. The instant invention with an internal skeleton covered by a shell casing and as further described below is not taught by the Russell et al. patent teachings.

None of the above inventions and patents, taken either singly or in combination, is seen to describe the instant invention as claimed.

SUMMARY OF THE INVENTION

Accordingly, it is a principal object of the invention to provide an educational and/or recreational toy in the form of a substructure skeletal body covered by a shell encasement which is selectively secured about the substructure body or removed therefrom to reveal the configuration of the substructure, the shell when in place covering virtually the entire substructure body.

It is another object of the invention to provide an educational and/or recreational toy in the form of an animal, such as a dinosaur, with a substructure skeletal body encased or enshrouded in a removable two part shell which is simply snap fit together, the shell being configured to represent the external surface or skin of the dinosaur.

It is a further object of the invention to provide an educational and/or recreational toy in the form of an animal such as a dinosaur, with an internal skeletal body pigmented with a glow-in-the-dark material and a split shell, removable and replaceable on the skeletal body.

Still another object of the invention is to provide an educational and/or recreational toy in the form of an animal such as a dinosaur with an internal skeletal body and an external, removable and replaceable shell representing the skin or surface tissue of the animal, portions of the skeletal underbody protruding through the overlying shell for aesthetic appeal and/or recreational and educational purposes.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
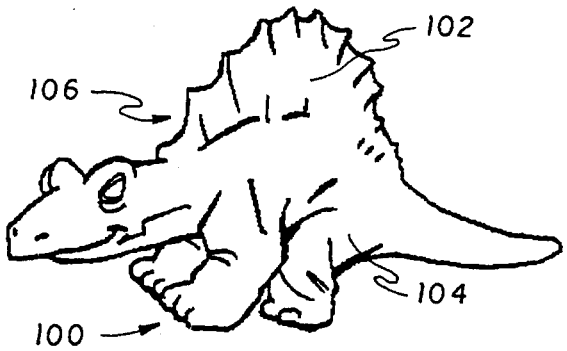
FIG. 1 is a perspective view of one embodiment of the invention, having the external appearance of a brontosaur.

The present invention is directed to an educational and/or recreational toy having a substructure skeletal body and a covering shell or skin, representative of the surface or skin of the figure that the toy is intended to represent. In the context of the embodiments of the instant invention, however, the toy is in the form of four different dinosaurs, each having an internal, somewhat pliable skeletal body and displaying the bone structure of the dinosaur represented by the toy, and a two part snap-together and take-apart shell covering or exoskeleton, representing the exposed skin surface of the creature represented by the figure.

Additionally, the interior skeletal body may be pigmented with a glow-in-the-dark material so as to be further attractive and appealing to the user or youngster. Also, the skeletal internal body and the external shell may be dimensioned and configured such that certain parts of the underlying skeletal body protrude through the outer shell, such as, a dorsal fin, horns, teeth and jaws, and spinal, bony plates. When the internal body is pigmented with a glow-in-the-dark material and assembled with the shell, and viewed in the dark, the glow-in-the-dark protruding parts lend a particularly appealing and dramatic character to the figure. Of course, the internal body alone, when pigmented with glow-in-the-dark material, provides a very dramatic figurine when viewed in darkness.

Of course, the animal or thing represented by the instant invention need not be limited to dinosaurs or even animals in general, for that matter. Virtually anything conceivable having an internal skeleton or supporting structure and a covering surface for the completed object may be represented by a figure created in accordance with the teachings of the instant invention. By way of example only, an airplane with an internal skeletal body in the form of the aircraft frame, or a building having an internal steel or concrete support structure, or a human figure with a skeleton covered by the skin surface, or perhaps a ship with an internal substructure representing keel, keelson and ribbing encased in a shell representing the hull can be created in accordance with the teachings of the instant invention.

When the instant invention takes the form of dinosaurs, however, there is instant recognition of both the skeleton construction of the extinct animals, as well as an appreciation of just what the animal may have looked like with the addition and assembly of the outer shell to the underlying skeleton. In the preferred embodiment, the toys are rather small, measuring about two to three inches high and about three to four inches long; the toys are mini-dinosaurs. A set of four different dinosaurs is disclosed hereinbelow, which may be marketed as a set. Or, the toy dinosaurs may be marketed as a promotional, free, giveaway item at outlets such as fast food restaurants. Each time a child visits an establishment, he or she is given a free toy. Thus, the child (with paying adult in tow, of course) is encouraged to make a return visit and collect a different dinosaur toy, until the set of four is complete. As will be further appreciated from the drawings, each figure is given an artistic, friendly, non-threatening appearance so as to be appealing even to very young children.

Figure 6:
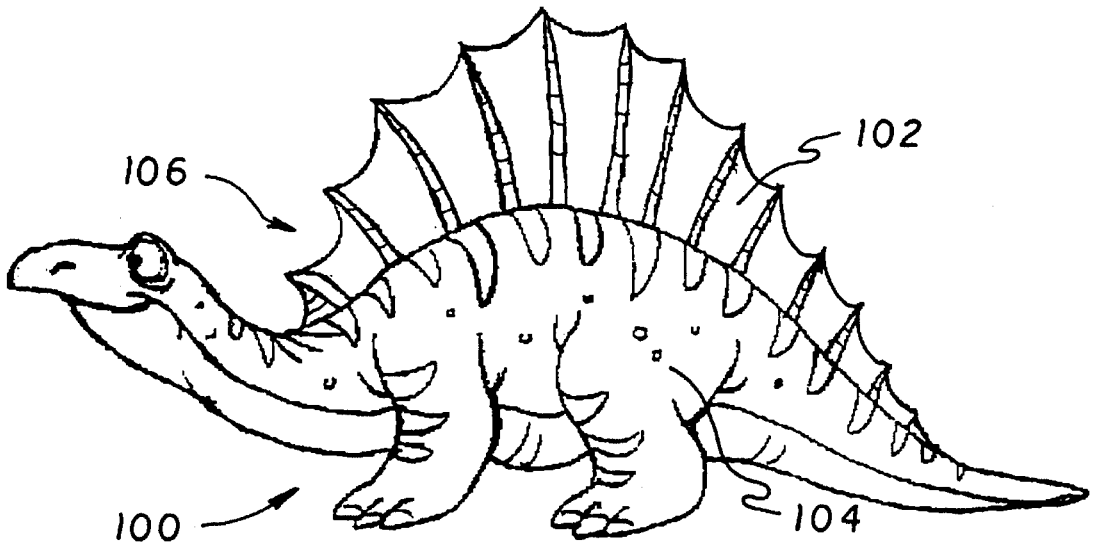
FIG. 6 is a side elevational view of the brontosaur figure seen in FIG. 1.
Figure 7:
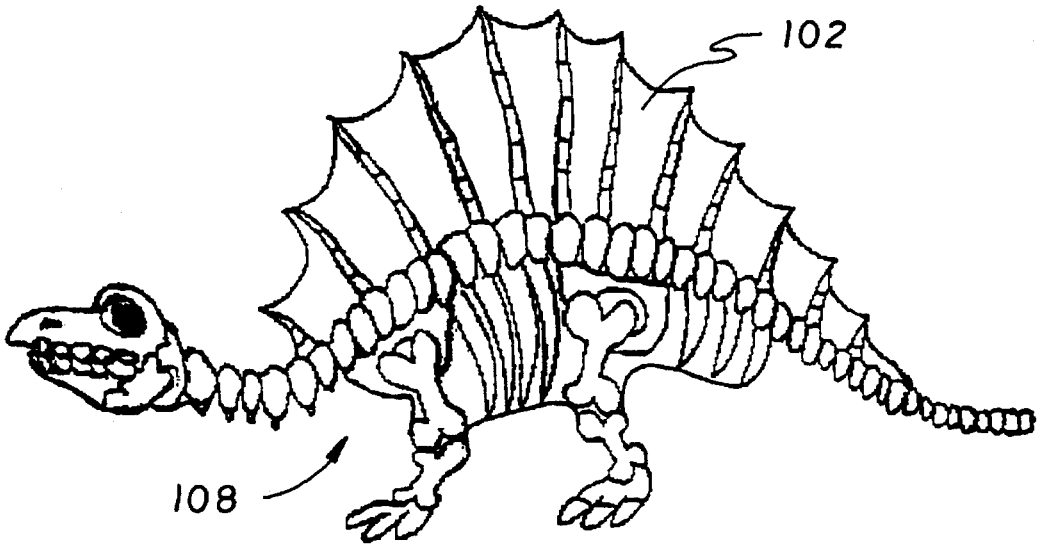
FIG. 7 is a side elevational view of the skeletal body or underbody of the brontosaur figure of FIG. 6.

Four particular dinosaur representations are of particular interest in the context of the instant invention, however, probably because of their instant recognition by even very young children. One toy, as seen in FIG. 1, represents a brontosaur 100, a huge, fourteen foot high, seventy foot long sauropod dinosaur of the Jurassic genus Apatosaurus with a long flexible neck and thick arms and legs. For further aesthetic appeal, a friendly but ferocious appearing dorsal fin 102 has been added, which protrudes from the plane formed by the mating shells 104, 106, making up the outer skin or exoskeleton. With reference to FIGS. 6 and 7, the entire, interior skeletal body 108 is seen in FIG. 7; when shells 104, 106 are assembled about body 108, as is seen in FIG. 6, the fin 102 of the body 108 protrudes through the upper side of the shells 104, 106. When the interior, skeletal body 108 is made of glow-in-the-dark material, the toy has even more exiting appeal to any youngster when his or her room is completely dark.

Figure 2:
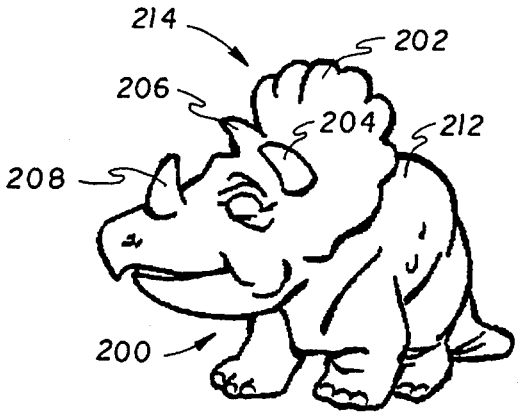
FIG. 2 is a perspective view of the invention in the configuration of a triceratops.
Figure 8:
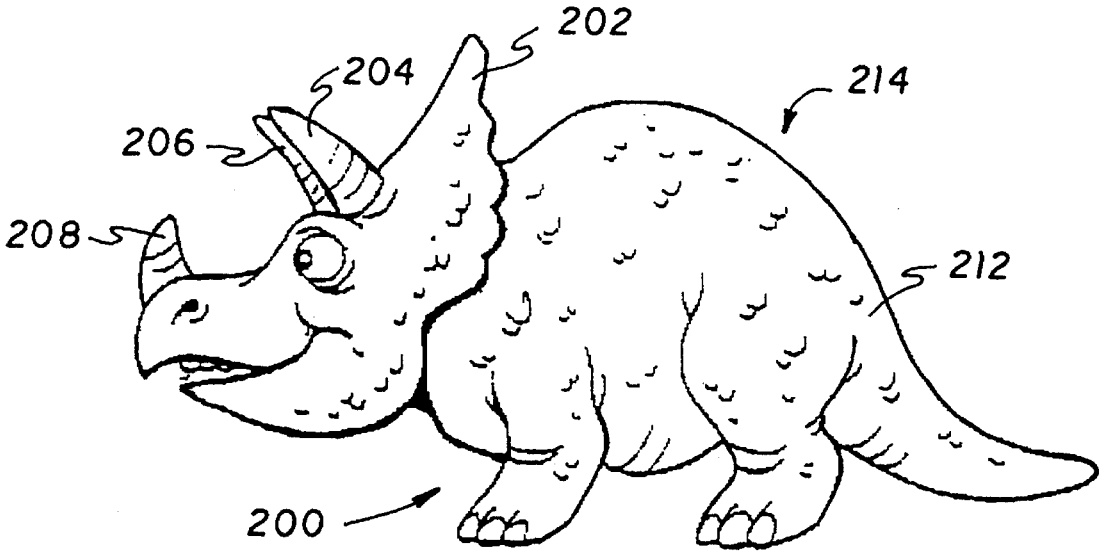
FIG. 8 is a side elevational view of the triceratops figure as shown in FIG. 2.
Figure 9:
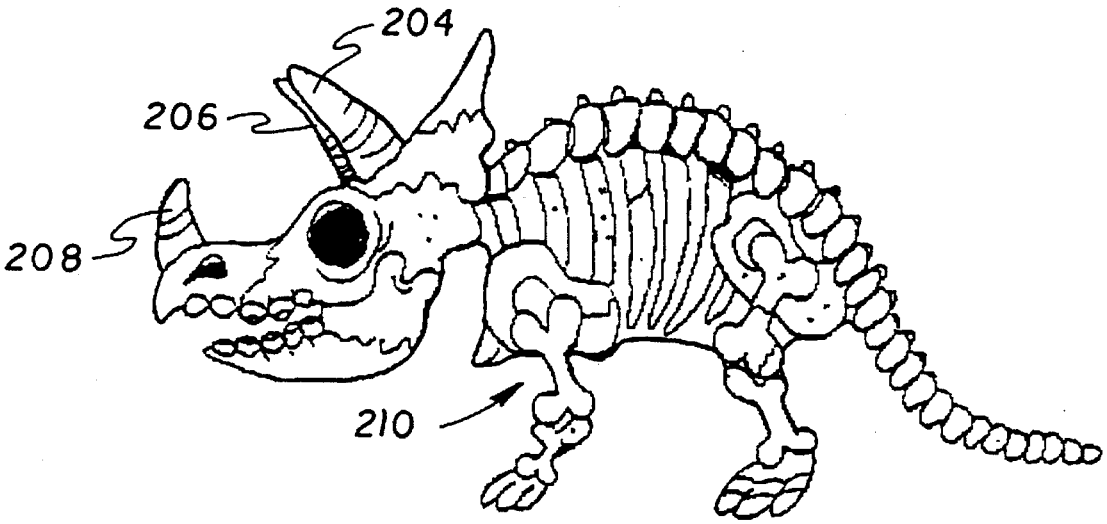
FIG. 9 is a side elevational view of the skeletal body or underbody of the triceratops figure of FIG. 8.

A second dinosaur character, also readily recognized by youngsters, is the triceratops 200, seen in FIGS. 2 and 8, a rather massive, plant-eating Cretaceous dinosaur of the genus Triceratops, and having a bony, dramatic crest 202 extended upwardly and curved forwardly from the neck, a horn 204, 206 over each eye, and a horn 208 over the nose. In this instance, these three horns are formed as a part of the internal skeletal structure 210, depicted in FIG. 9, and protrude through the exoskeleton of the completely assembled toy. As is the case with the other embodiments, the external shell is made up of two halves 212, 214. Again, as is the case with other models discussed above, the toy can be particularly captivating in appearance in a completely dark environment, with the three glow-in-the-dark horns extended from the outer shell of the toy.

Figure 3:
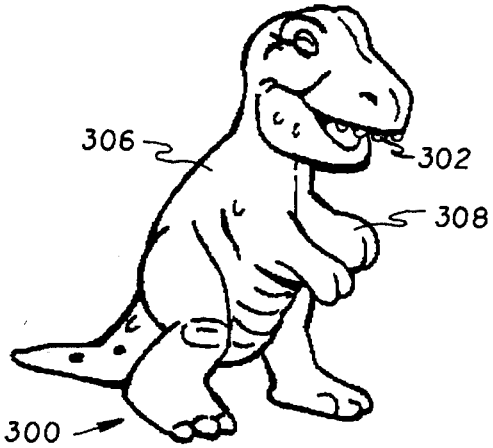
FIG. 3 is a perspective view of a figurine according to the invention in the shape of tyrannosaurus rex.
Figure 11:
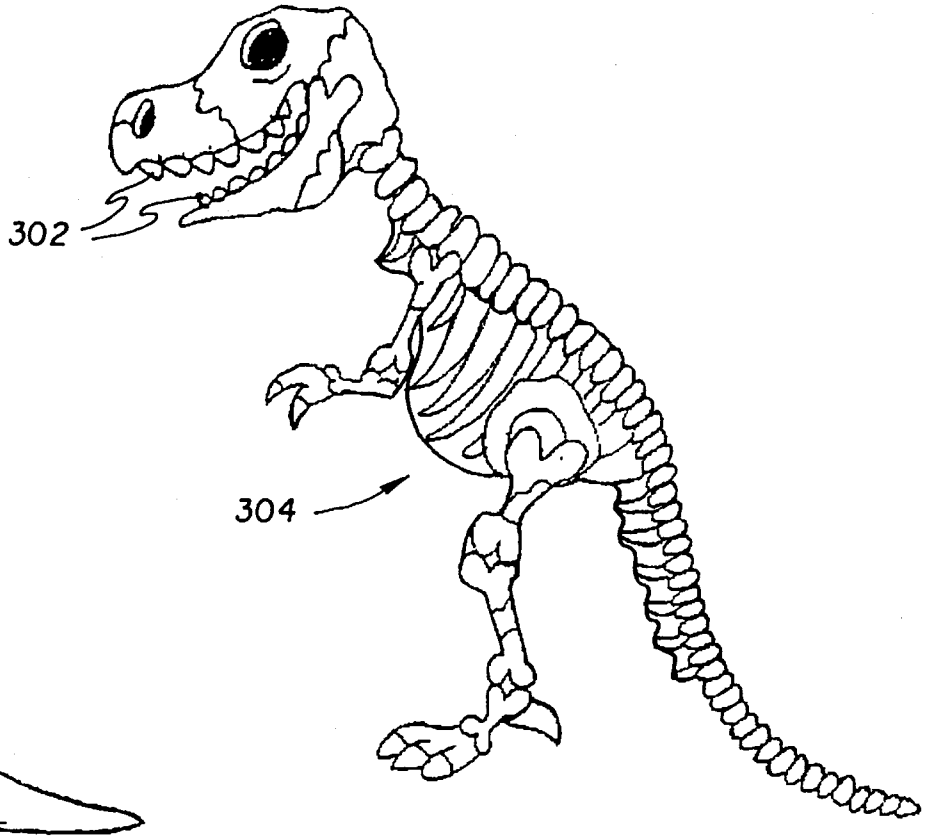
FIG. 11 is a side elevational view of the skeletal body or underbody of the tyrannosaurus rex figure of FIG. 10.
Figure 10:
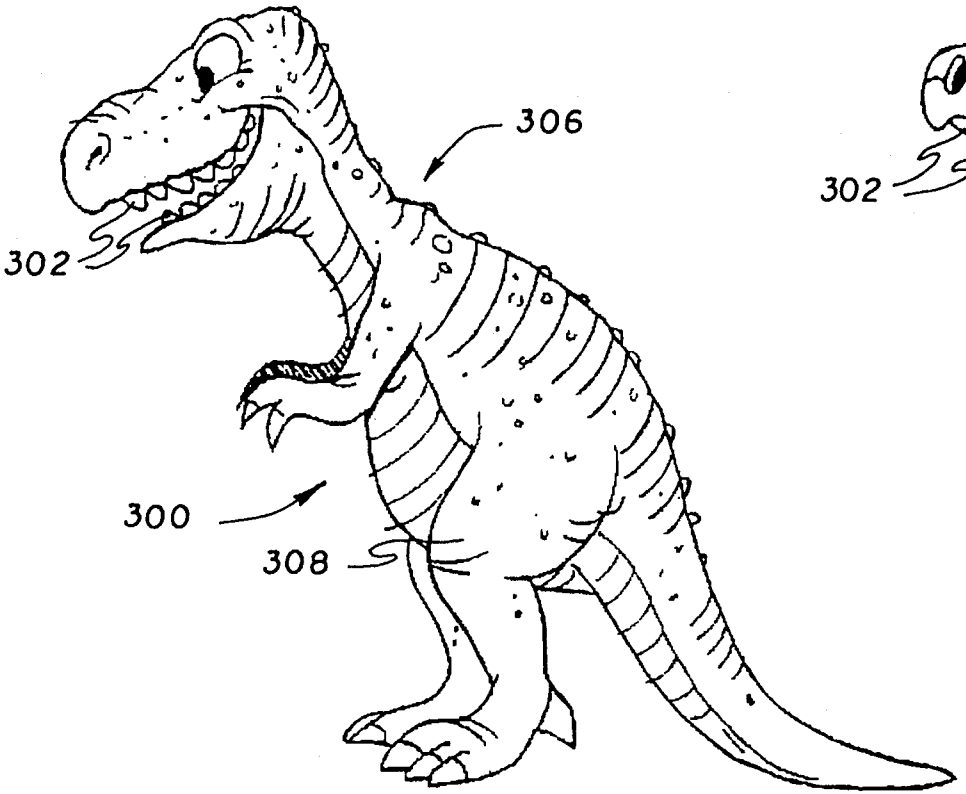
FIG. 10 is a side elevational view of the tyrannosaurus rex figure as depicted in FIG. 3.

Another, third dinosaur represented by FIGS. 3 and 10 is the tyrannosaur 300, a large, twenty foot high and fifty foot long theropod dinosaur of the late Cretaceous period; the particular tyrannosaur represented in FIGS. 3 and 10 is the instantly recognized *Tyrannosaurus rex*, a particularly awesome dinosaur rendered relatively friendly as a take apart, educational and/or recreational toy in the instant invention. As can be appreciated from FIGS. 3 and 10, the open mouth formed by the external shell or exoskeleton reveals the inner jaws 302 with rows of impressive teeth, formed as a part of the internal skeleton body 304, depicted in FIG. 11. The external skin or surface shell portion of the animal includes the two shell halves 306 and 308. When the skeleton is fabricated of glow-in-the-dark material and the toy is viewed in complete darkness, the appearance is obviously rather striking and dramatic.

Figure 4:
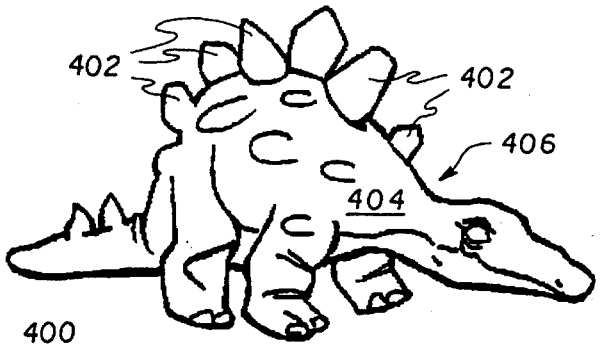
FIG. 4 is a perspective view of a toy according to the invention in the configuration of a stegosaurus.
Figure 12:
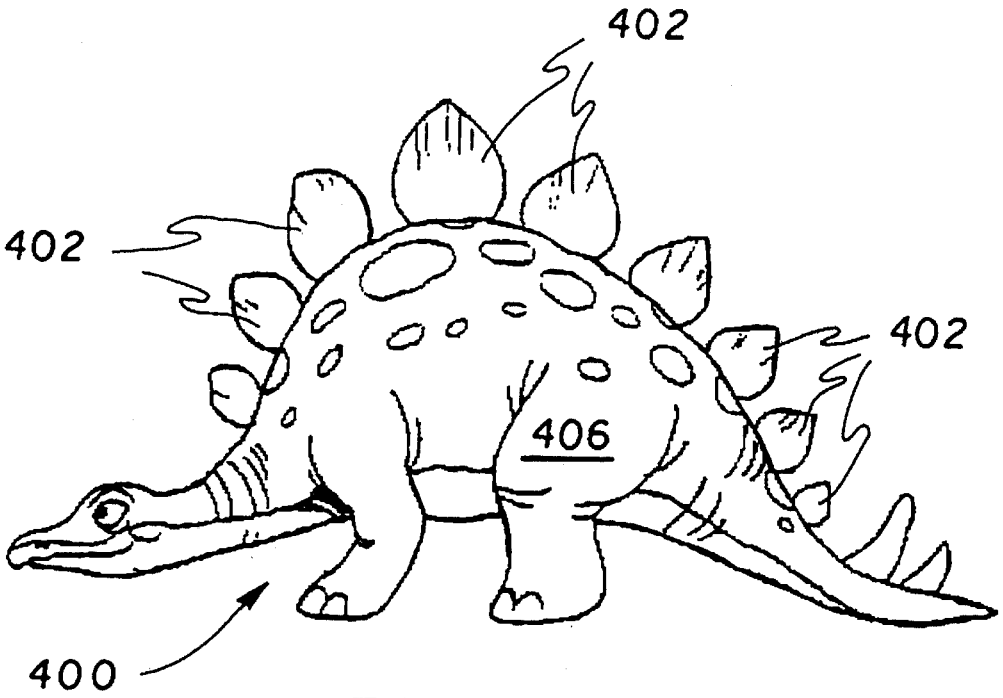
FIG. 12 is a side elevational view of the stegosaurus figure as shown in FIG. 4.
Figure 13:
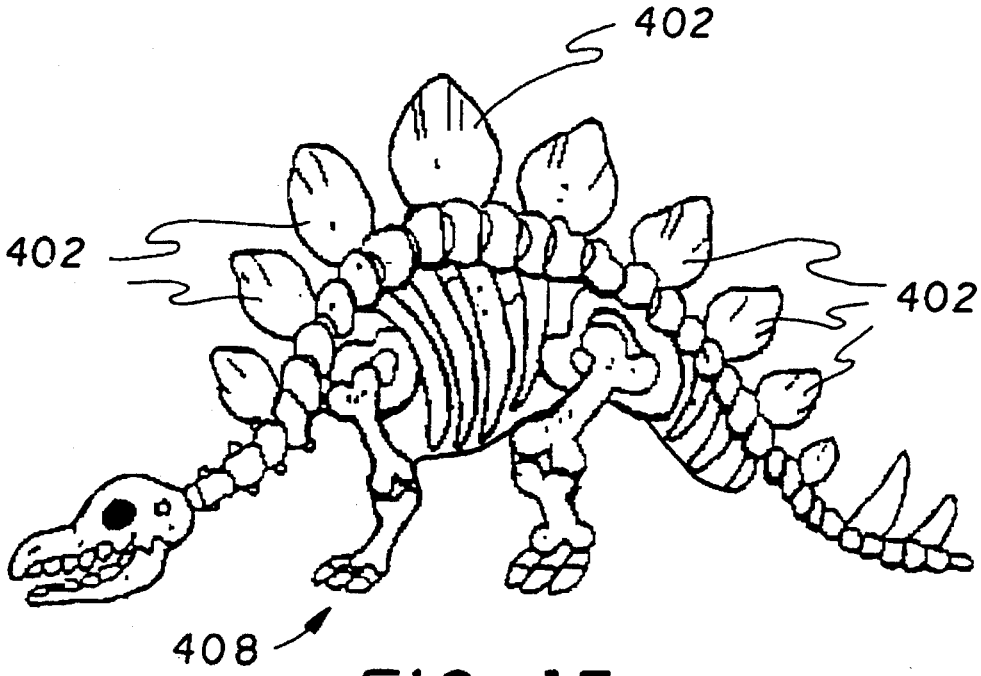
FIG. 13 is a side elevational view of the skeletal body or underbody of the stegosaurus figure of FIG. 12.

A fourth dinosaur illustrated is the stegosaur 400, as seen in FIGS. 4 and 12. The stegosaur is a plant eating dinosaur about eighteen feet in length, of the Jurassic and Cretaceous family Stegosauridae, having a series of bony plates 402 along the back or spine. As is apparent from FIGS. 12 and 13, the bony plates 402 extending throughout the length of the back of the toy are formed as part of the internal skeleton. Mating shell segments or halves 404, 406 make up the external surface of the stegosaur. The interior skeletal body 408 including the back, bony plates 402 is illustrated in FIG. 13. When the internal skeleton is made of glow-in-the-dark material, and the assembled toy is viewed in a very dark environment, the protruding appearance of the bony plates 402 along the backside of the toy is startling and surprisingly eye catching.

Figure 5:
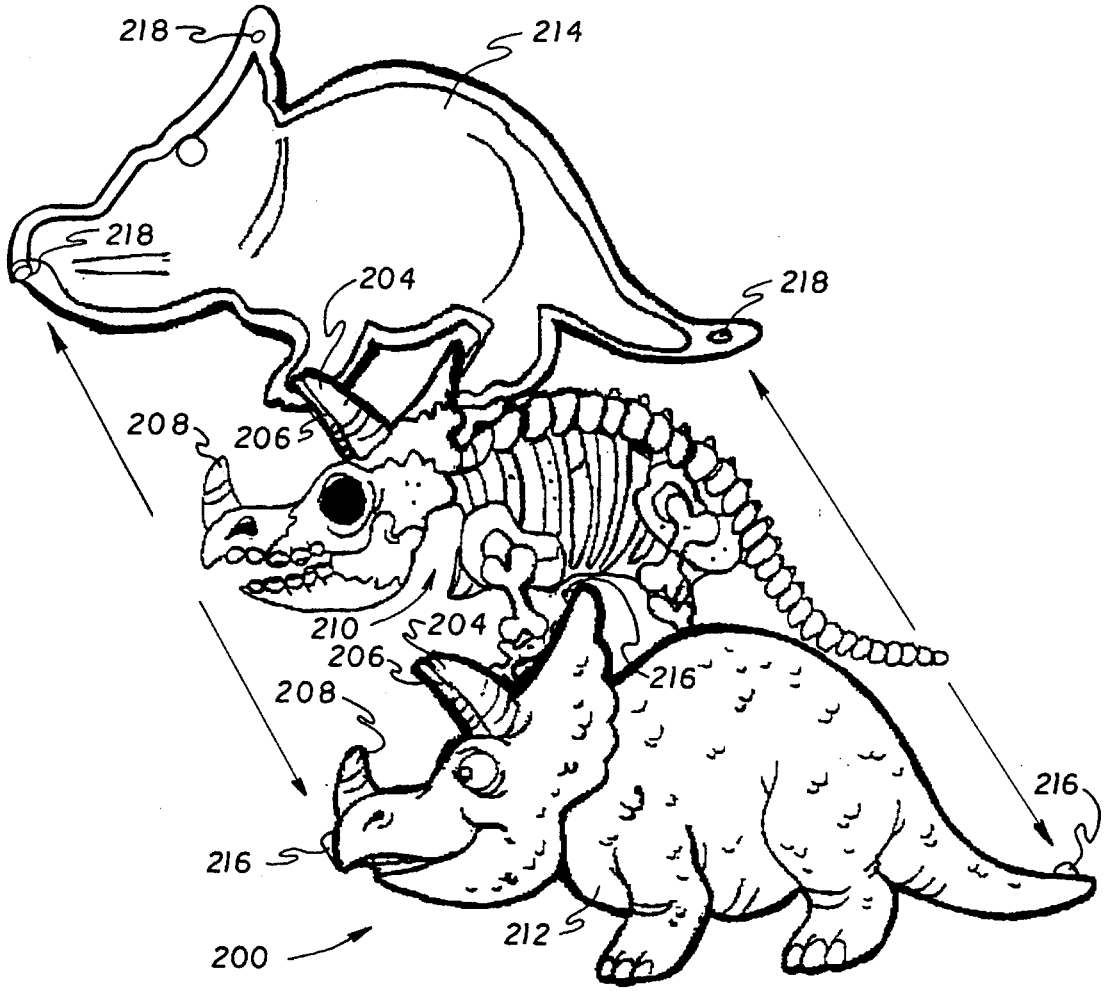
FIG. 5 is an exploded, perspective view of the embodiment of the invention seen in FIG. 2 (a triceratops) and is representative of the construction of all of the embodiments of the invention.

Turning now to FIG. 5, a discussion of the put together and take apart construction according to a preferred embodiment of the invention will be discussed. This drawing figure shows the internal construction details of the triceratops 200, but the other three dinosaurs depicted in the other drawing figures are constructed similarly. In FIG. 5, simple pin projections 216 which are friction fit with mating receptacles 218 are seen, the parts being dimensioned and configured so that the shell halves 212 and 214 are easily snap fit together with use of one's fingers, the shells being just as easily taken apart by pulling oppositely on the shell halves 212 and 214. Some artistic license has been taken with reference to FIG. 5, the lower part of the figure also showing the protruding three horns 204, 206, 208, which in reality are, of course, a part of the internal skeletal body 210, as is seen in the center portion of the drawing figure. FIG. 5 simply illustrates how the lower, complete toy 200, is separated into its three components, namely, shell 212, internal skeletal body 210, and the other, mating shell 214.

In a preferred embodiment, the various components making up the toy animals or figures are made of a selected plastic material, the material being somewhat pliable so as not to present any sharp, dangerous edging or edges. Also, the somewhat pliable construction permits the child or user to assemble and take apart the toy components more easily. Furthermore, the selected material has sufficient memory as to return to its initial configuration, even after repeated hard use or play.

Preferably, the components are fabricated from chlorinated polyolefins, e.g., polyvinyl chloride (PVC) or polyvinylidene chloride. Other suitable plastics materials might include: polyoelefins, e.g., polyethylene, polypropylene or polybutylene; polystyrenes, e.g., polystyrene, polymethylstyrene, polyethylstyrene; nylons, e.g., nylon 6,6; nylon 6,10, etc.; urethanes; block copolymers such as acrylonitrile-butadiene-styrene (ABS), and styrene-acrylonitrile (SAN); polyacrylics, polyalkylcrylics, polyacrylates, polyalkylacrylates (Plexiglass or Lucite); polyesters such as polyethylene terephthalate or polybutylene terephthalate; thermosetting formaldehyde resins, e.g., resoles, novolacs, aminoplasts (Bakelite); and polycarbonates. Of further consideration are materials such as natural and synthetic rubbers (elastomers) and copolymers, ethylene-propylene-diene monomer (EPDM) rubbers, styrene-isoprene-styrene (SIS) rubbers, SBR, buna rubber, and polyester elastomers. As for the glow-in-the-dark material which may be added as a pigment to the inner skeletal bodies 108, 210, 304 and 408, the material may be phosphorescent; such materials are notoriously well understood by those skilled in the art and, in any event, form no part of the instant invention per se.

It is to be understood that the present invention is not limited to the embodiments described above, but encompasses any and all embodiments within the scope of the following claims.

I claim:

1. An educational and recreational toy structure representative of a dinosaur, comprising:

a unitary skeletal body having at least one projecting predetermined part, said body dimensioned and configured to represent the skeleton of a dinosaur, said skeletal body being pigmented with a glow-in-the-dark material;

a shell for encasing said skeletal body and having an external configuration and appearance representative of the outer surface skin of said dinosaur;

said shell comprising a pair of mating shell halves, dimensioned and configured to cover less than the entire said unitary skeletal body to allow projection of said at least one predetermined part of said unitary skeleton outside said shell; and means for detachably securing said shell about said skeletal body; whereby said shell may be readily attached about said skeletal body and readily detached therefrom so that said toy may be alternately configured to represent a complete dinosaur and the skeletal structure of said dinosaur.

2. The toy dinosaur according to claim 1, wherein said at least once predetermined projecting part of said unitary skeleton when the toy is completely assembled is selected from a dorsal fin, eye and nose horns, jaws and teeth, and bony spinal plates.

3. The toy dinosaur according to claim 1, wherein said means for detachably securing said shell about said skeletal body comprise a plurality of pin projections and a corresponding plurality of receptacles for friction fit with said pin projections, said pin projections being formed on one of said mating shell halves and said receptacles being formed on the other of said mating shell halves, thus to readily assemble and disassemble said mating shell halves.

4. The toy dinosaur according to claim 3, further comprising a set of four toys, each having a said skeletal body and said shell encasing said skeletal body, a first toy representing a brontosaur, a second toy representing a tyrannosaur, a third toy representing a triceratops, and a fourth toy representing a stegosaur.

5. The dinosaur toy according to claim 2, wherein said at least one projecting predetermined skeletal part when the toy is completely assembled is a dorsal fin.

6. The dinosaur toy according to claim 2, wherein said at least one projecting predetermined skeletal part when the toy is completely assembled are eye and nose horns.

7. The dinosaur toy according to claim 2, wherein said at least one projecting predetermined skeletal part visible when the toy is completely assembled are jaws and teeth.

8. The dinosaur toy according to claim 2, wherein said projecting predetermined skeletal part visible when the toy is completely assembled are bony spinal plates.

9. The dinosaur toy according to claim 1, wherein said glow-in-dark-material is phosphorescent material.

10. The dinosaur toy according to claim 3, wherein said dinosaur toy represents a brontosaur.

11. The dinosaur toy according to claim 3, wherein said dinosaur toy represents a tyrannosaur.

12. The dinosaur toy according to claim 3, wherein said dinosaur toy represents a triceratops.

13. The dinosaur toy according to claim 3, wherein said dinosaur toy reoresents a stegosaur.

* * * * *